United States Patent [19]

Hasselmann

[11] 4,407,086

[45] Oct. 4, 1983

[54] WEAPON

[76] Inventor: William J. Hasselmann, 2818 Orlando Dr., Pittsburgh, Pa. 15235

[21] Appl. No.: 265,906

[22] Filed: May 21, 1981

[51] Int. Cl.[3] ..... F41C 27/00

[52] U.S. Cl. ..... 42/90

[58] Field of Search ..... 42/90; 81/3.05

[56] References Cited

U.S. PATENT DOCUMENTS

| | | | |
|---|---|---|---|
| 23,223 | 3/1859 | Baldwin | 81/3.05 |
| 464,099 | 12/1891 | Von Wehrstedt | 42/90 |
| 3,208,302 | 9/1965 | Lewis et al. | 42/90 |
| 3,747,252 | 7/1973 | Walker | 42/90 |
| 4,327,515 | 5/1982 | Kuryn | 42/90 |

OTHER PUBLICATIONS

Watson, Wyndle; "Muzzle Loading"; *Pittsburgh Press* Dec. 20, 1980.

*Primary Examiner*—Charles T. Jordan
*Attorney, Agent, or Firm*—Hymen Diamond

[57] ABSTRACT

Apparatus for removing a musket ball undesirably lodged in the breech of a muzzle-loading gun. The apparatus includes a ramrod to one end of which a ball starter is secured firmly but manually removable and to the opposite end of which a screw-jag tool is similarly secured. Using the grip of the ball starter as a handle, the tool is screwed into the musket ball and is then withdrawn through the barrel. To prevent rotation of the grip of the ball starter relative to its shaft when the musket ball is being engaged and disengagement of the ball of the ball starter when the musket ball is being pulled out, the shaft of the ball starter is keyed to its grip. Normally the ramrod is carried on the gun and the ball starter and screw-jag tool are carried in the pouch with the bullets and powder.

5 Claims, 6 Drawing Figures

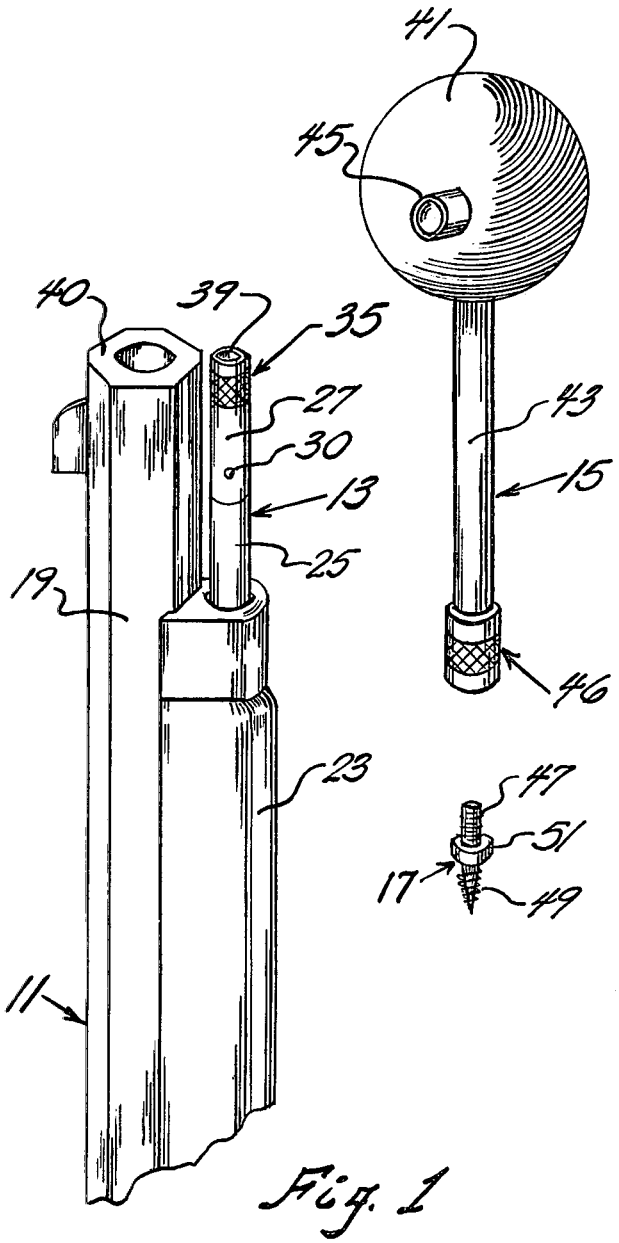
Fig. 1
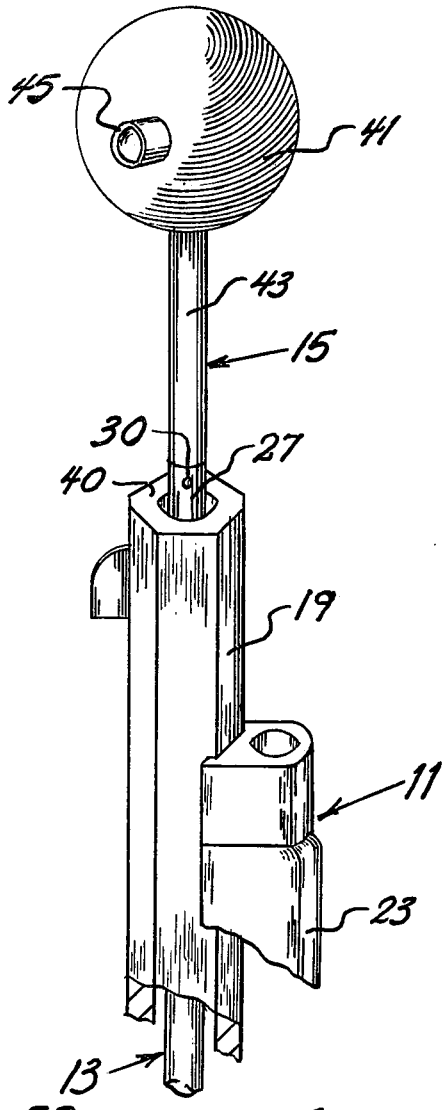
Fig. 2
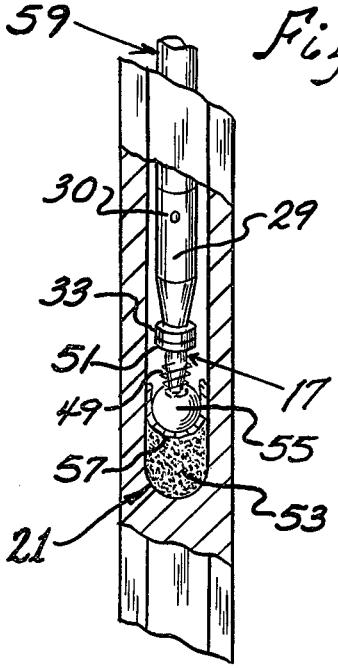

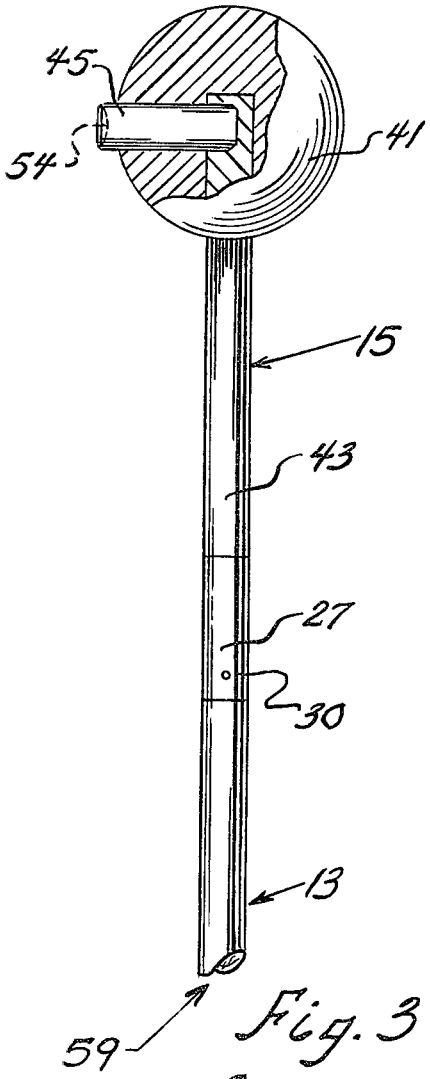
Fig. 3
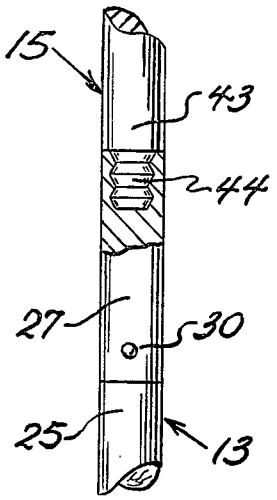
Fig. 4
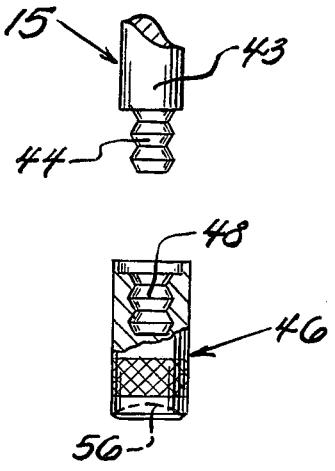
Fig. 5
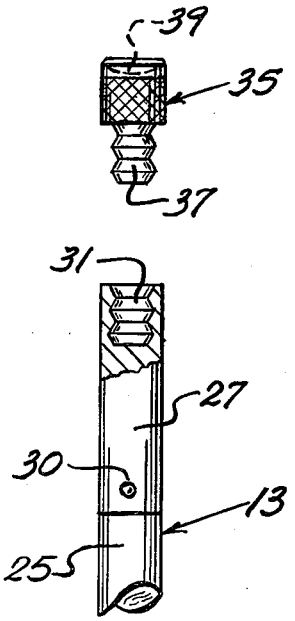
Fig. 6
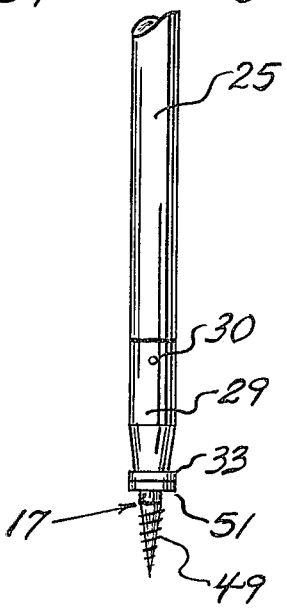

WEAPON

BACKGROUND OF THE INVENTION

This invention relates to weapons and has particular relationship to muzzle-loading guns. As indicated by its name, a muzzle-loading gun is loaded through its barrel. An adequate charge of powder is first poured down the barrel into the breech of the gun. Then a projectile, typically a musket/minnie ball, is thrust through the barrel into the breech. The ball may be wrapped in a greased patch. The musket ball is tamped down tightly on the powder. The gun is then primed and discharged. A muzzle-loading gun is provided with a ramrod which is removably contained in a receptacle extending from the barrel. In addition, there is a ball starter which is carried separately from the gun with the powder and musket balls. The ball starter includes a grip from which a bar or shaft extends. In addition, the ball starter includes a stud which penetrates the grip and is keyed to the shaft. Typically, the grip is spherical. The musket ball is seated in the muzzle of the barrel with the stud or key and then thrust into the barrel a short distance by the shaft. Then it is thrust into the breech and tamped to the powder by the ramrod. The musket ball has a small flat tip called a "sprue" which is produced when it is molded. It is essential that the ball be inserted in the barrel with this tip axially outwardly. The musket ball is a tight sliding fit in the barrel. The orientation of the tip is thus facilitated.

Recently considerable interest has been aroused in muzzle-loading guns. An important cause of this interest is the action of a number of states, including Pennsylvania, in setting open-season periods for the hunting of wild animals with muzzle-loading guns. A typical open-season period has a duration of about a week. The hunters necessarily desire to devote the whole time permitted to the sport. Frequently a musket ball is undesirably lodged in the breech. This may happen when the gun is primed and fails to fire when an attempt is made to discharge it because the powder is damp or aged. At times the hunter forgets to deposit the powder in the breech and the ball lodges in the breech. So that the hunter may continue to enjoy the period for which he has set aside a vacation or has interrupted his work, it is necessary that the musket ball be promptyly and readily removed from the breech in which it is lodged. It is an object of this invention to accomplish this purpose.

In accordance with the teachings of the prior art, the ramrod is threaded at its inner end to receive a screw-jag tool. This tool is to be injected or screwed into the musket ball by pressing on the ramrod and turning it. Once the ball is engaged by the tool, the tool is to be removed by pulling on the ramrod. This expedient has proven ineffective. The length of the ramrod is such that, when inserted in the barrel, it projects only a short distance from the muzzle so that it may be carried in its receptacle on the gun. Being of this length, the ramrod cannot be effectively gripped to exert the force required to inject the screw-jag tool into the musket ball and to withdraw the ball from the barrel.

Another prior-art expedient is an extra-long ramrod or a ramrod with a handle attached to it. Such a ramrod can neither be carried in the gun nor can it, because of its length, be conveniently carried as auxiliary or accessory equipment.

Because of the deficiencies of the prior-art facilities for removing lodged musket balls, many hunters have found it necessary to interrupt their hunting trip and hava a gunsmith remove the musket ball. It is an object of the invention to overcome the above-described drawbacks and deficiencies of the prior art and to provide a readily available facility for effectively removing a musket ball undesirably lodged in the breech of a muzzle-loading gun.

SUMMARY OF THE INVENTION

In accordance with this invention, the ramrod and the ball starter, which constitute part of the equipment currently carried with a muzzle-loading gun, are integrated with a screw-jag tool to provide a highly effective facility for removing a musket ball lodged in the breech. The screw-jag tool is a relatively small item, several of which can be readily carried with the other auxiliary equipment. In the practice of this invention, an instrument for removing a musket ball is provided by securing the ball starter to one end of the ramrod and the screw-jag tool to the opposite end. Both components are secured to the ramrod firmly but manually removable. To remove a musket ball, this instrument is passed through the barrel into the breech so that the screw-jag tool engages the ball. The grip of the ball starter is grasped and the screw-jag tool is pressed against the ball and turned so that it is screwed into the ball. The instrument and the ball are then pulled from the barrel by pulling on the grip. The grip of the ball starter is prevented from rotating relative to the shaft or from being pulled from the shaft by the stud which is keyed to the shaft.

Typically, the ball starter and the one end of the ramrod and the screw-jag tool and the other end of the ramrod are each provided with mating threads which are turnable in the same direction to effect engagement of the ramrod and the ball starter and tool. The screw-jag tool is provided with a sharp threaded tip like a wood screw. This screw is also turnable in the same direction as the ball starter and screw-jag tool to effect engagement with the musket ball. In this way, disengagement of the ball starter or screw-jag tool from the ramrod while engaging the musket ball is precluded.

The end of the ramrod to which the ball starter is connected is provided with a cap when in normal use. This end is engaged with the musket ball when this ball is thrust into the breech. The end of the ball starter shaft and the end of the stud are also provided with a protective cap.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which:

FIG. 1 is a view in side elevation showing a muzzle-loading gun fragmentally and the auxiliary components which are integrated to remove a musket ball in the practice of this invention;

FIG. 2 is a view in side elevation, with a part sectioned longitudinally, showing an embodiment of the instrument in accordance with this invention in the process of removing a musket ball;

FIG. 3 is a view in side elevation, with the grip of the ball starter partly sectioned, showing the instrument according to this invention;

FIG. 4 is a fragmental view in side elevation, with a part sectioned longitudinally, showing the manner in which the ball starter is secured to the ramrod;

FIG. 5 is a fragmental exploded view in side elevation, with a part sectioned, showing the manner in which the protective cap is secured to the ball starter; and FIG. 6 is a fragmental exploded view in side elevation, with a part sectioned, showing the manner in which the protective cap is secured to the ramrod.

DETAILED DESCRIPTION OF EMBODIMENT

The apparatus shown in the drawings include a muzzle-loading gun 11, a ramrod 13, a ball starter 15, and screw-jag tool 17.

The gun 11 includes a barrel 19, a breech 21 (FIG. 2), a forestock receptacle 23 for receiving the ramrod 13, and other parts (not shown) such as the buttstock, the trigger mechanism, etc. The receptacle 23 extends integrally from the barrel 19 generally parallel to the barrel.

The ramrod 13 includes a central section 25 of wood or wood impregnated with fiberglass or other plastic. Secured to one end of the section 25, the ramrod has a sleeve adapter 27 to receive the ball starter 15 (FIG. 4). At the opposite end of central section 25, another sleeve adapter 29 is secured (FIG. 2). This adapter 29 receives the screw-jag tool 17. The adapters 27 and 29 are each secured to their respective opposite ends of section 25 by a pin 30. The adapter 27 is provided with an internal thread 31 (FIG. 6). The adapter 29 tapers towards its outer end to a flange 33 and is also provided with an internal thread (not shown). In the normal use of the apparatus, the ramrod 13 is provided with a cap 35 having a steam 37 with an external thread which mates with thread 31. At its outer end, the cap 35 has a groove or indentation 39 (FIGS. 1, 6).

In the normal use of the gun, the ramrod 13 is held in the receptacle 23 with the cap 35 at the end (FIG. 1). For the convenience of the user, the ramrod 13 extends only as far as the muzzle 40 as shown in FIG. 1.

The ball starter 15 includes a grip 41 from which a rod or shaft 43 extends (FIG. 1). Typically, the grip 41 may be spherical. The shaft 43 extends into the grip 41 to a position above the diametral plane of the grip which is perpendicular to the axis of shaft 43. Near its tip within grip 41, the shaft 43 has a groove or key slot into which stud or key 45 (FIG. 3) extends. The outer end 44 of the shaft 43 is threaded. The thread on end 44 mates with the thread 31 in the adapter 27 of ramrod 13. The ball starter is provided with a cap 46 (FIG. 5) which has an internal thread 48 that mates with the thread in end 44. In normal use, the cap 46 is screwed onto the end 44 (FIG. 4).

The screw-jag tool 17 has a threaded stem 47 and a sharp threaded tip 49 like a wood screw. There is a flange 51 between the stem 47 and the tip 49. The thread on stem 47 mates with the internal thread (not shown) in the adapter 29. When a lodged musket ball is to be removed, the stem 47 is screwed into adapter 29 so that the flanges 33 and 51 abut.

In normal use of the apparatus, the ramrod 13 and the ball starter 15 are capped. After the powder 53 is deposited in the breech 21, a musket ball 55, wrapped in a greased patch 57, is seated into the muzzle 40 by the stud or key of the ball starter. To facilitate the starting, the stud 45 has a dimple 54 in its end. The ball 55 is seated at the muzzle 40 with its tip or sprue outwardly and approximately centered along the axis of the barrel. The musket ball 55 is then partially moved down the barrel by ball starter shaft 43. Then the ball is moved by ramrod 13 into firm engagement with the powder 51 with the patch interposed between the ball and the powder. The upper surface of the ball 55 is seated in the groove 39 of cap 35. The ball starter cap 46 has a dimple 56 in its end to facilitate engagement with the ball 55.

If the ball 55 becomes lodged in the breech 21, the cap 35 is removed from ramrod 13 and the cap 46 is removed from ball starter 15 and the instrument 59 shown in FIGS. 2 and 3 is formed. The ball starter 15 is screwed into the thread 31 of adapter 27 and the screw-jag tool 17 is screwed into adapter 29. The instrument 59 is then inserted in the barrel 19 so that the tip 49 of screw-jag tool 17 engages the ball 55. The tool 17 is then screwed into ball 55 with the aid of grip 41. The ball 55 is typically composed of lead and the screw-jag tool 17 may be composed of tool steel. The ball 55 is then firmly attached to the screw-jag tool and may be pulled out. The thread in end 44 and the thread 31 and the thread in end 47 and the thread (not shown) in the adapter 29 and the thread in tip 49 are all in the same direction so that the ramrod remains engaged to its end components 15 and 17 when the tip 49 is being screwed into ball 55. The stud or key 45 prevents the grip 41 from turning relative to shaft 43 when the ball 55 is being engaged by tip 49 and shaft 43 from being pulled from the grip when the ball 55 is being pulled out.

While a preferred embodiment of this invention has been disclosed herein, many modifications thereof are feasible. This invention is not to be restricted except insofar as is necessitated by the spirit of the appended claims.

I claim:

1. For use with a muzzle-loading gun for removal of a musket ball undesirably lodged in the breech of said gun, the instrument comprising a ramrod, having a ball starter secured at one end thereof and a screw-jag tool secured at the opposite end thereof, said ball starter and said tool each being secured at said one end and at said opposite end respectively, firmly but manually removable, said one end and the end of said ball starter which is secured to said one end being provided with mating threads which are engaged when the ball starter is secured to said one end, said opposite end and the end of said screw-jag tool secured to said opposite end being provided with mating threads which are engaged when said screw-jag tool is secured to said opposite end, and the screw-jag tool being provided with a second thread for screwing into the ball, the direction of said mating threads of said ball starter and of said one end and of said screw-jag tool and of said opposite end, and the direction of said second thread, being such that the engagement of the threads of said ball starter and of said one end and of said screw-jag tool and of said opposite end are effected by turning the starter and tool in the same direction (clockwise or counterclockwise) with reference to the axis of the ramrod and the engagement of the screw-jag tool with the ball is effected by turning the screw-jag tool in the same direction.

2. For use with a muzzle-loading gun for removal of a musket ball undesirably lodged in the breech of said gun, the instrument comprising a ramrod, having a ball starter secured at one end thereof and a screw-jag tool secured at the opposite end thereof, said ball starter and said tool each being secured at said one end and at said opposite end respectively, firmly but manually removable, said one end of said ramrod being provided with a protective cap, said cap to be secured to said one end when said ball starter is removed therefrom, the outer end of said cap being formed to facilitate the injection of said ball into the breech of said gun through its barrel by engagement of said ball with said outer end and the exerting of thrust on said ball through said outer end.

3. For use with a muzzle-loading gun for removal of a musket ball undesirably lodged in the breech of said gun, the instrument comprising a ramrod, having a ball starter secured at one end thereof and a screw-jag tool secured at the opposite end thereof, said ball starter and said tool each being secured at said one end and at said opposite end respectively, firmly but manually removable, said end of said ball starter being provided with a cap, said cap to be secured to said end of said ball starter when said ball starter is removed from said ramrod.

4. For use with a muzzle-loading gun for removal of a musket ball undesirably lodged in the breech of said gun, the instrument comprising a ramrod, having a ball starter secured at one end thereof and a screw-jag tool secured at the opposite end thereof, said ball starter and said tool each being secured at said one end and at said opposite end respectively, firmly but manually removable, said ball starter including a grip and a rod, said rod extending into said grip at one end, the other end of said rod to be secured to said ramrod, said ball starter also including a key penetrating said grip and being keyed to said rod within said grip to prevent rotation of said grip relative to said rod when high torque is applied to said grip is causing the screw-jag tool to engage firmly said ball or when high tension is applied to said grip to remove the so engaged ball through the barrel of said gun.

5. For use with a muzzle-loading gun for removal of a musket ball undesirably lodged in in the breech of said gun, the instrument comprising a ramrod, having a ball starter secured at one end thereof and a screw-jag tool secured at the opposite end thereof, said ball starter and said tool each being secured at said one end and at said opposite end respectively, firmly but manually removable, said ball starter including a grip from which a rod extends, said rod being secured at its end remote from said grip to said one end of said ramrod, said one end of said ramrod and said remote end of said grip being each provided with a cap secured thereto in the normal use of the gun.

* * * * *